US006459059B1

(12) United States Patent
Greenberg et al.

(10) Patent No.: US 6,459,059 B1
(45) Date of Patent: Oct. 1, 2002

(54) RETURN SPRING FOR A CIRCUIT INTERRUPTER OPERATING MECHANISM

(75) Inventors: Randy Greenberg, Granby, CT (US); Roger N. Castonguay, Terryville, CT (US); Dave Christensen, Harwinton, CT (US); Hassan Girish, Plainville, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/527,479

(22) Filed: Mar. 16, 2000

(51) Int. Cl.[7] ..... H01H 23/00
(52) U.S. Cl. ..... 200/401; 335/172
(58) Field of Search ..... 200/401, 6 R; 335/172–176

(56) References Cited

U.S. PATENT DOCUMENTS

| | | | | | |
|---|---|---|---|---|---|
| 2,340,682 | A | * | 2/1944 | Powell | 200/147 |
| 2,719,203 | A | * | 9/1955 | Gelzheiser et al. | 200/144 |
| 2,937,254 | A | * | 5/1960 | Ericson | 200/114 |
| 3,089,930 | A | | 5/1963 | Pastene et al. | |
| 3,158,717 | A | * | 11/1964 | Jencks et al. | 200/116 |
| 3,162,739 | A | * | 12/1964 | Klein et al. | 200/88 |
| 3,197,582 | A | * | 7/1965 | Norden | 200/50 |
| 3,307,002 | A | * | 2/1967 | Cooper | 200/116 |
| 3,492,614 | A | | 1/1970 | DeAngelo et al. | |
| 3,517,356 | A | * | 6/1970 | Hanafusa | 335/16 |
| 3,631,369 | A | * | 12/1971 | Menocal | 337/110 |
| 3,803,455 | A | * | 4/1974 | Willard | 317/33 SC |
| 3,883,781 | A | * | 5/1975 | Cotton | 317/14 R |
| 4,129,762 | A | * | 12/1978 | Bruchet | 200/153 G |
| 4,144,513 | A | * | 3/1979 | Shafer et al. | 335/46 |
| 4,158,119 | A | * | 6/1979 | Krakik | 200/240 |
| 4,165,453 | A | * | 8/1979 | Hennemann | 200/153 G |
| 4,166,988 | A | * | 9/1979 | Clarcia et al. | 335/9 |

(List continued on next page.)

FOREIGN PATENT DOCUMENTS

| | | |
|---|---|---|
| BE | 819 008 A | 12/1974 |
| BE | 897 691 A | 1/1984 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |

(List continued on next page.)

*Primary Examiner*—P. Austin Bradley
*Assistant Examiner*—Lisa N. Klaus
(74) *Attorney, Agent, or Firm*—Cantor Colburn LLP

(57) ABSTRACT

A return spring mechanism is arranged to operate with a circuit breaker operating mechanism during a trip condition. The circuit breaker operating mechanism is movable between a tripped position, a reset position, an off position and an on position. The return spring mechanism is attached to the exterior of the circuit breaker frame and includes a return spring with a fixed end attached to the frame. When the circuit breaker is tripped, the return spring mechanism operates to provide an additional force to the handle yoke. The additional force applied by the return spring is predetermined to position the handle yoke intermediate to the handle yoke positions when the circuit breaker is off and on. Thus, the movement of the handle yoke to the intermediate position provides clear indication that the circuit breaker is in the tripped condition.

12 Claims, 16 Drawing Sheets

U.S. PATENT DOCUMENTS 4,220,934 A * 9/1980 Wafer et al. ..... 335/16
4,255,732 A * 3/1981 Wafer et al. ..... 335/16
4,259,651 A * 3/1981 Yamat ..... 335/16
4,263,492 A * 4/1981 Maier et al. ..... 200/288
4,276,527 A * 6/1981 Gerbert-Gaillard et al. ... 335/39
4,297,663 A * 10/1981 Seymour et al. ..... 335/20
4,301,342 A * 11/1981 Castonguay et al. .... 20/153 SC
4,360,852 A * 11/1982 Gilmore ..... 361/98
4,368,444 A * 1/1983 Preuss et al. ..... 335/166
4,375,021 A * 2/1983 Pardini et al. ..... 200/147 B
4,375,022 A * 2/1983 Daussin et al. ..... 200/148 R
4,376,270 A * 3/1983 Staffen ..... 335/21
4,383,146 A * 5/1983 Bur ..... 200/17 R
4,392,036 A * 7/1983 Troebel et al. ..... 200/322
4,393,283 A 7/1983 Masuda ..... 200/51.09
4,401,872 A 8/1983 Boichot-Castagne
et al. ..... 200/153 G
4,409,573 A 10/1983 DiMarco et al. ..... 335/16
4,435,690 A 3/1984 Link et al. ..... 335/37
4,467,297 A 8/1984 Boichot-Castagne et al. .. 335/8
4,468,645 A 8/1984 Gerbert-Gaillard et al. ... 335/42
4,470,027 A 9/1984 Link et al. ..... 335/16
4,479,143 A 10/1984 Watanabe et al. ..... 358/44
4,488,133 A 12/1984 McClellan et al. ..... 335/16
4,492,941 A 1/1985 Nagel ..... 335/13
4,541,032 A 9/1985 Schwab ..... 361/331
4,546,224 A 10/1985 Mostosi ..... 200/153 G
4,550,360 A 10/1985 Dougherty ..... 361/93
4,562,419 A 12/1985 Preuss et al. ..... 335/195
4,589,052 A 5/1986 Dougherty ..... 361/94
4,595,812 A 6/1986 Tamaru et al. ..... 200/307
4,611,187 A 9/1986 Banfi ..... 335/16
4,612,430 A 9/1986 Sloan et al. ..... 200/327
4,616,198 A 10/1986 Pardini ..... 335/16
4,622,444 A 11/1986 Kandatsu et al. ..... 200/303
4,631,625 A 12/1986 Alexander et al. ..... 361/94
4,642,431 A 2/1987 Tedesco et al. ..... 200/153 G
4,644,438 A 2/1987 Puccinelli et al. ..... 361/75
4,649,247 A 3/1987 Preuss et al. ..... 200/244
4,658,322 A 4/1987 Rivera ..... 361/37
4,672,501 A 6/1987 Bilac et al. ..... 361/96
4,675,481 A 6/1987 Makowski et al. ..... 200/144 R
4,682,264 A 7/1987 Demeyer ..... 361/96
4,689,712 A 8/1987 Demeyer ..... 361/96
4,694,373 A 9/1987 Demeyer ..... 361/96
4,710,845 A 12/1987 Demeyer ..... 361/96
4,717,985 A 1/1988 Demeyer ..... 361/96
4,733,211 A 3/1988 Castonguay et al. ..... 335/192
4,733,321 A 3/1988 Lindeperg ..... 361/96
4,764,650 A 8/1988 Bur et al. ..... 200/153 G
4,768,007 A 8/1988 Mertz et al. ..... 335/202
4,780,786 A 10/1988 Weynachter et al. ..... 361/87
4,831,221 A 5/1989 Yu et al. ..... 200/553
4,870,531 A 9/1989 Danek ..... 361/93
4,883,931 A 11/1989 Batteux et al. ..... 200/148 R
4,884,047 A 11/1989 Baginski et al. ..... 335/10
4,884,164 A 11/1989 Dziura et al. ..... 361/97
4,900,882 A 2/1990 Bernard et al. ..... 200/147 R
4,910,485 A 3/1990 Bolongeat-Mobleu
et al. ..... 335/195
4,914,541 A 4/1990 Tripodi et al. ..... 361/94
4,916,420 A 4/1990 Bartolo et al. ..... 335/172
4,916,421 A 4/1990 Pardini et al. ..... 335/185
4,926,282 A 5/1990 McGhie ..... 361/102
4,935,590 A 6/1990 Malkin et al. ..... 200/148 A
4,937,706 A 6/1990 Schueller et al. ..... 361/396
4,939,492 A 7/1990 Raso et al. ..... 335/42
4,943,691 A 7/1990 Mertz et al. ..... 200/151
4,943,888 A 7/1990 Jacob et al. ..... 361/96
4,950,855 A 8/1990 Bolonegeat-Mobleu
et al. ..... 200/148 A
4,951,019 A 8/1990 Gula ..... 335/166
4,952,897 A 8/1990 Barnel et al. ..... 335/147
4,958,135 A 9/1990 Baginski et al. ..... 335/8
4,965,543 A 10/1990 Batteux ..... 335/174
4,983,788 A 1/1991 Pardini ..... 200/16 R
5,001,313 A 3/1991 Leclerq et al. ..... 200/148 B
5,004,878 A 4/1991 Seymour et al. ..... 200/144 R
5,029,301 A 7/1991 Nebon et al. ..... 335/16
5,030,804 A 7/1991 Abri ..... 200/323
5,057,655 A 10/1991 Kersusan et al. ..... 200/148 B
5,077,627 A 12/1991 Fraisse ..... 361/93
5,083,081 A 1/1992 Barrault et al. ..... 324/126
5,095,183 A 3/1992 Raphard et al. ..... 200/148 A
5,103,198 A 4/1992 Morel et al. ..... 335/6
5,115,371 A 5/1992 Tripodi ..... 361/106
5,120,921 A 6/1992 DiMarco et al. ..... 200/401
5,132,865 A 7/1992 Mertaz et al. ..... 361/6
5,138,121 A 8/1992 Streich et al. ..... 200/293
5,140,115 A 8/1992 Morris ..... 200/308
5,153,802 A 10/1992 Mertz et al. ..... 361/18
5,155,315 A 10/1992 Malkin et al. ..... 200/148 R
5,166,483 A 11/1992 Kersusan et al. ..... 200/144 A
5,172,087 A 12/1992 Castonguay et al. ..... 335/160
5,178,504 A 1/1993 Falchi ..... 411/553
5,184,717 A 2/1993 Chou et al. ..... 200/401
5,187,339 A 2/1993 Lissandrin ..... 200/148 F
5,198,956 A 3/1993 Dvorak ..... 361/106
5,200,724 A 4/1993 Gula et al. ..... 335/166
5,210,385 A 5/1993 Morel et al. ..... 200/146 R
5,224,590 A * 7/1993 Milianowicz et al. ..... 200/400
5,239,150 A 8/1993 Bolongeat-Mobleu
et al. ..... 200/148 R
5,260,533 A 11/1993 Livesey et al. ..... 200/401
5,262,744 A 11/1993 Arnold et al. ..... 335/8
5,280,144 A 1/1994 Bolongeat-Mobleu
et al. ..... 200/148 R
5,281,776 A 1/1994 Morel et al. ..... 200/144
5,296,660 A 3/1994 Morel et al. ..... 200/146 R
5,296,664 A 3/1994 Crookston et al. ..... 200/401
5,298,874 A 3/1994 Morel et al. ..... 335/8
5,300,907 A 4/1994 Nereau et al. ..... 335/172
5,310,971 A 5/1994 Vial et al. ..... 200/244
5,313,180 A 5/1994 Vial et al. ..... 335/16
5,317,471 A 5/1994 Izoard et al. ..... 361/105
5,331,500 A 7/1994 Corcoles et al. ..... 361/93
5,334,808 A 8/1994 Bur et al. ..... 200/50
5,341,191 A 8/1994 Crookston et al. ..... 335/16
5,347,096 A 9/1994 Bolongeat-Mobleu
et al. ..... 200/148 B
5,347,097 A 9/1994 Bolongeat-Mobleu
et al. ..... 200/148 B
5,350,892 A 9/1994 Rozier ..... 200/144 B
5,357,066 A 10/1994 Morel et al. ..... 200/17 R
5,357,068 A 10/1994 Rozier ..... 200/148 R
5,357,394 A 10/1994 Piney ..... 361/72
5,361,052 A 11/1994 Ferullo et al. ..... 335/172
5,373,130 A 12/1994 Barrault et al. ..... 200/147 R
5,379,013 A 1/1995 Coudert ..... 335/17
5,424,701 A 6/1995 Castonguary et al. ..... 335/172
5,438,176 A 8/1995 Bonnardel et al. ..... 200/400
5,440,088 A 8/1995 Coudert et al. ..... 200/303
5,449,871 A 9/1995 Batteux et al. ..... 200/401
5,450,048 A 9/1995 Leger et al. ..... 335/132
5,451,729 A 9/1995 Onderka et al. ..... 200/18
5,457,295 A 10/1995 Tanibe et al. ..... 200/293
5,467,069 A 11/1995 Payet-Burin et al. ..... 335/42
5,469,121 A 11/1995 Payet-Burin ..... 335/16
5,475,558 A 12/1995 Barjonnet et al. ..... 361/64
5,477,016 A 12/1995 Baginski et al. ..... 200/43.11

| | | | | | |
|---|---|---|---|---|---|
| 5,479,143 | A | | 12/1995 | Payet-Burin | 335/202 |
| 5,483,212 | A | | 1/1996 | Lankuttis et al. | 335/132 |
| 5,485,343 | A | | 1/1996 | Santos et al. | 361/115 |
| D367,265 | S | * | 2/1996 | Yamagata et al. | D13/160 |
| 5,493,083 | A | | 2/1996 | Olivier | 200/17 R |
| 5,504,284 | A | | 4/1996 | Lazareth et al. | 200/50 R |
| 5,504,290 | A | | 4/1996 | Baginski et al. | 200/401 |
| 5,510,761 | A | | 4/1996 | Boder et al. | 335/172 |
| 5,512,720 | A | | 4/1996 | Coudert et al. | 200/400 |
| 5,515,018 | A | | 5/1996 | DiMarco et al. | 335/16 |
| 5,519,561 | A | | 5/1996 | Mrenna et al. | 361/105 |
| 5,534,674 | A | | 7/1996 | Steffens | 218/154 |
| 5,534,832 | A | | 7/1996 | Duchemin et al. | 335/16 |
| 5,534,835 | A | | 7/1996 | McColloch et al. | 335/172 |
| 5,534,840 | A | | 7/1996 | Cuingnet | 337/1 |
| 5,539,168 | A | | 7/1996 | Linzenich | 200/303 |
| 5,543,595 | A | | 8/1996 | Mader et al. | 200/401 |
| 5,552,755 | A | | 9/1996 | Fello et al. | 335/18 |
| 5,581,219 | A | | 12/1996 | Nozawa et al. | 335/132 |
| 5,604,656 | A | | 2/1997 | Derrick et al. | 361/187 |
| 5,608,367 | A | | 3/1997 | Zoller et al. | 335/132 |
| 5,784,233 | A | | 7/1998 | Bastard et al. | 361/36 |
| 6,166,344 | A | * | 12/2000 | Castonguay et al. | 200/401 |

FOREIGN PATENT DOCUMENTS

| | | |
|---|---|---|
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 061 092 | 9/1992 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| SU | 1 227 978 | 4/1986 |
| WO | 92/00598 | 1/1992 |
| WO | 92/05649 | 4/1992 |
| WO | 94/00901 | 1/1994 |
| WO | WO 99/62092 A | 12/1999 |

* cited by examiner

RETURN SPRING FOR A CIRCUIT INTERRUPTER OPERATING MECHANISM

BACKGROUND OF THE INVENTION

The present invention is directed to circuit interrupters, and more particularly to a return spring for a circuit interrupter operating mechanism.

Commonly, multiple contacts, each disposed within a cassette, are arranged within a circuit breaker system for protection of individual phases of current. The operating mechanism is positioned over one of the cassettes and generally connected to all of the cassettes in the system.

Circuit interrupter operating mechanisms are used to manually control the opening and closing of movable contact structures within circuit interrupters. Additionally, these operating mechanisms in response to a trip signal, for example, from an actuator device, will rapidly open the movable contact structure and interrupt the circuit. To transfer the forces (e.g., to manually control the contact structure or to rapidly trip the structure with an actuator), operating mechanisms employ powerful springs and linkage arrangements. The spring energy provides a high output force to the separable contacts.

A circuit interrupter operating mechanism utilizes a handle to indicate whether the circuit breaker is in the "on", "off" or trip condition. When the movable contact structures are closed, the circuit breaker is "on". Conversely, when the movable contact structures are open, the circuit breaker is "off". When the circuit breaker trips due to an overload condition, the handle is intended to indicate that a trip has occurred by moving to an intermediate position located between the "on" and "off" positions. Typically, when a circuit breaker is tripped, the force applied to the handle by the springs is low. This is partly due to compact circuit breaker designs as well as the need to trip the circuit breaker should the handle be blocked. Because of the low force applied to the handle when the circuit breaker is tripped, it may not be visually obvious that the circuit breaker tripped. The handle may not be in a readily identifiable intermediate position.

SUMMARY OF THE INVENTION

In an exemplary embodiment of the present invention, a return spring mechanism is arranged to operate with a circuit breaker operating mechanism during a trip condition. The operating mechanism is movable between a tripped position, a reset position, an off position and an on position. The return spring mechanism is attached to the exterior of the circuit breaker frame and includes a return spring. A handle yoke is pivotally connected to the frame. A spring is configured to move the handle yoke a first distance when the operating mechanism in a tripped condition. The return spring is arranged to move the handle yoke a second distance when the operating mechanism is in a tripped condition. The movement of the handle yoke a second distance provides clear indication that the circuit breaker is in the tripped condition.

DETAILED DESCRIPTION OF THE INVENTION

Figure 1:
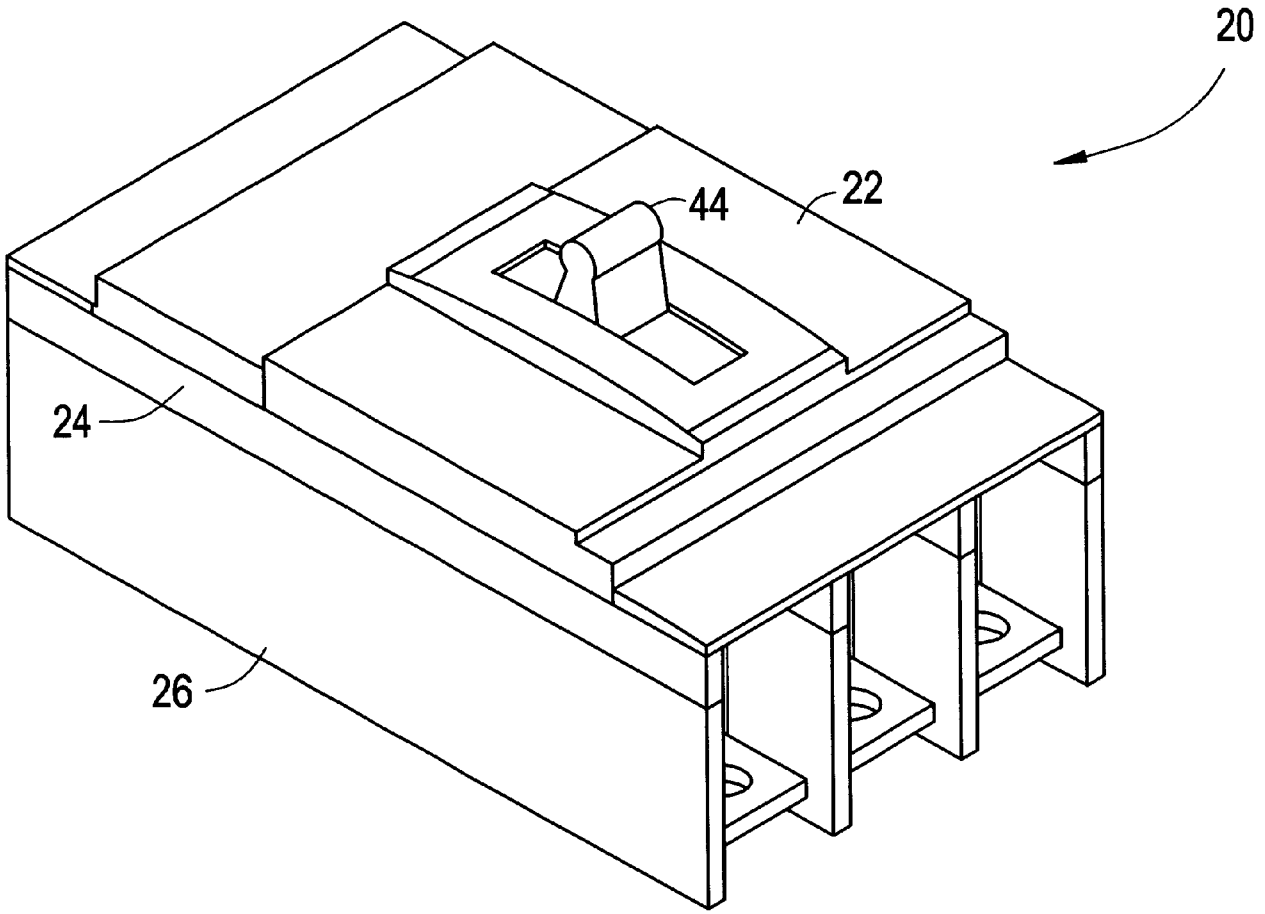
FIG. 1 is an isometric view of a molded case circuit breaker employing an operating mechanism embodied by the present invention.
Figure 2:
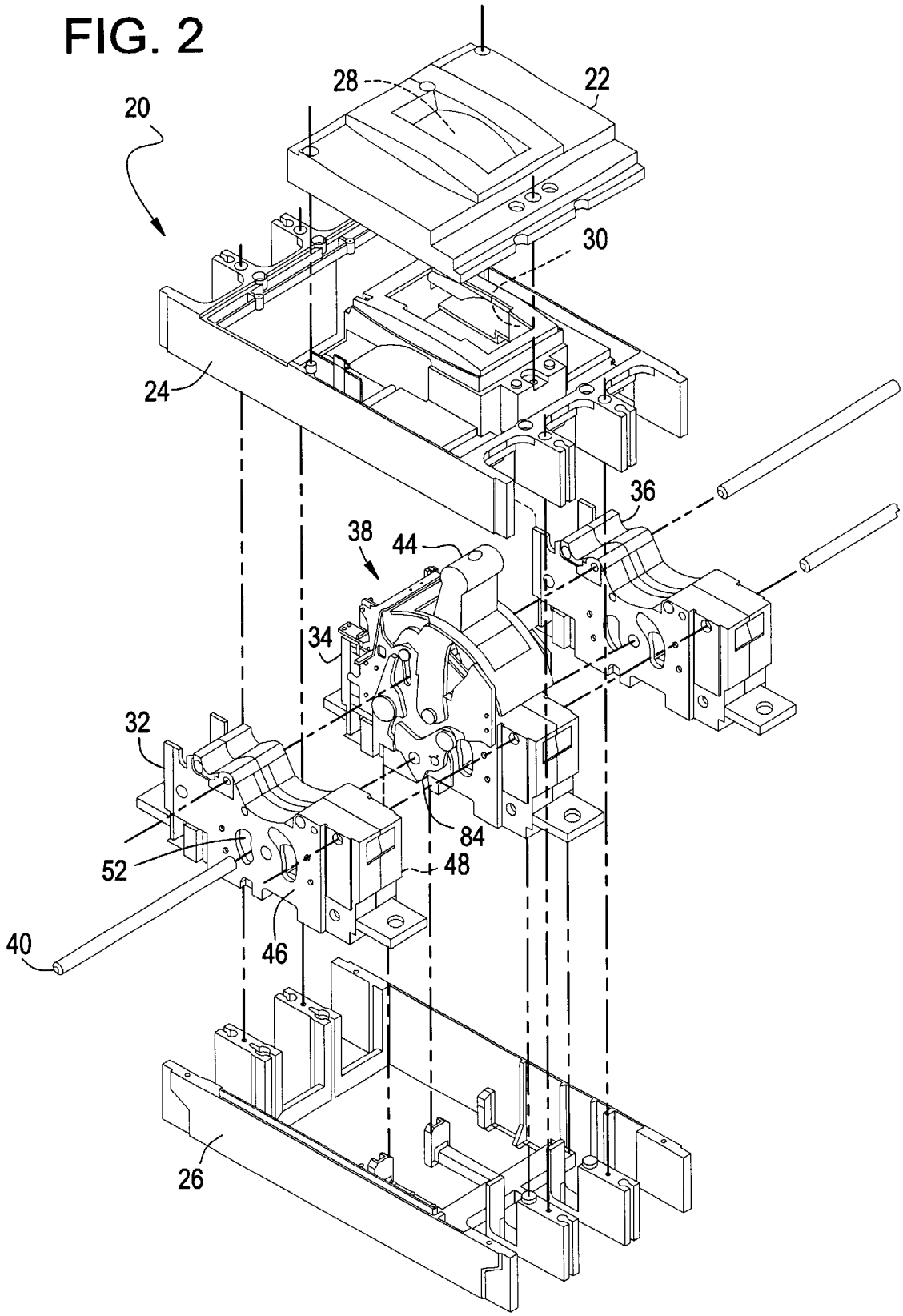
FIG. 2 is an exploded view of the circuit breaker of FIG. 1.

Referring to FIGS. 1 and 2, a circuit breaker 20 is shown. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36. Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
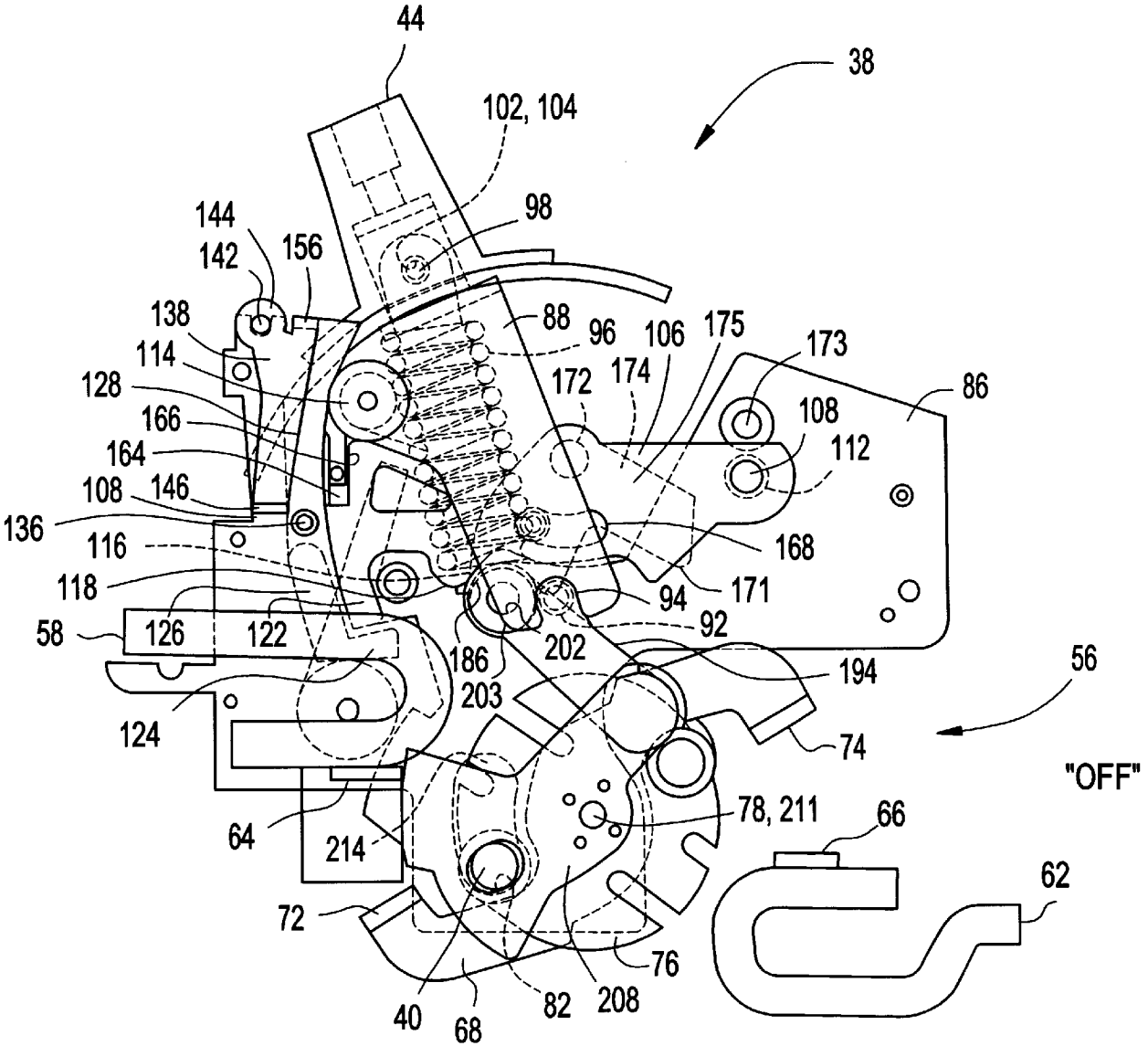
FIG. 3 is a partial sectional view of a rotary contact structure and operating mechanism embodied by the present invention in the "off" position.
Figure 4:
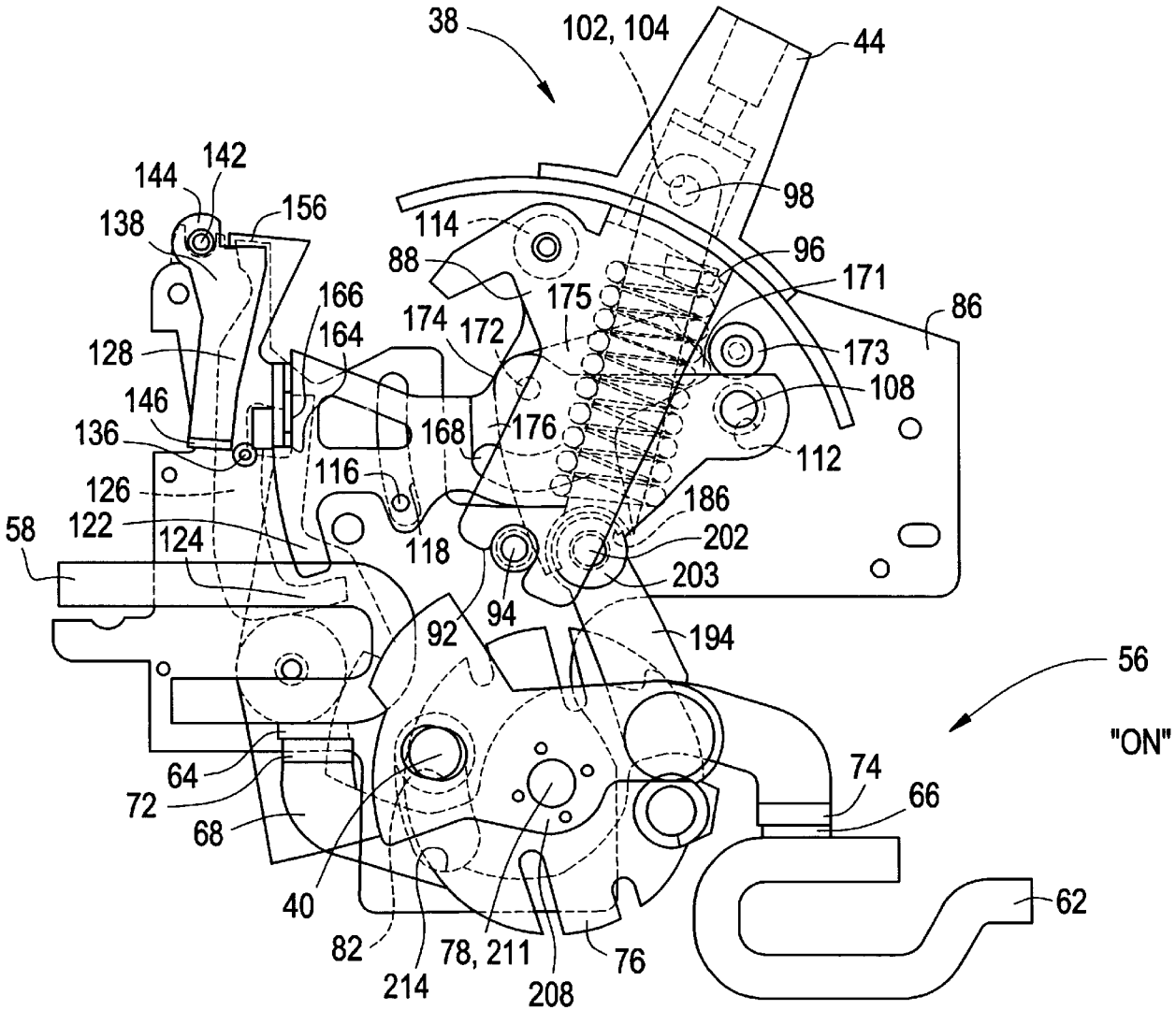
FIG. 4 is a partial sectional view of the rotary contact structure and operating mechanism of FIG. 3 in the "on" position.
Figure 5:
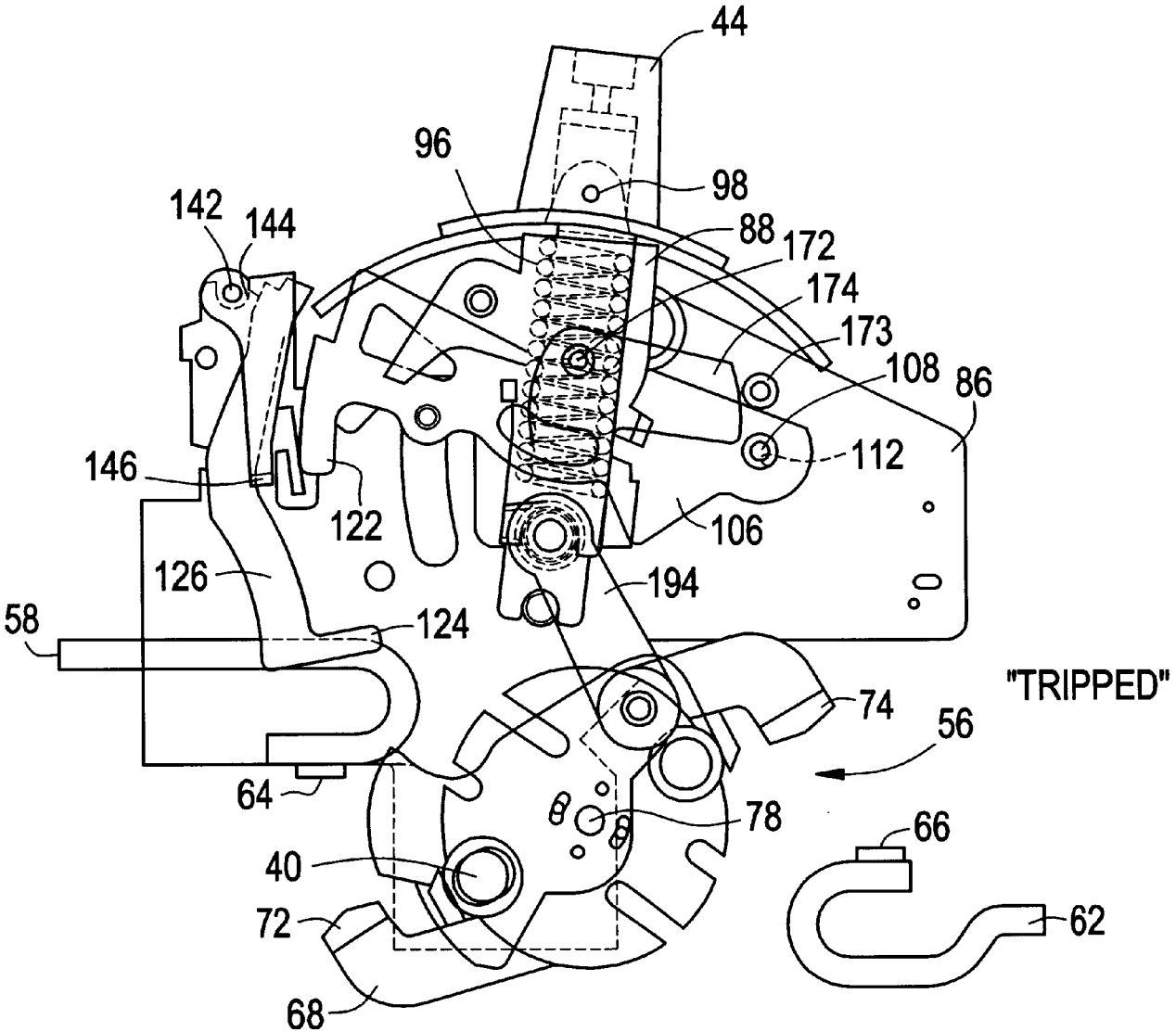
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a line side contact strap 58 and load side contact strap 62 for connection with a power source and a protected circuit (not shown), respectively. Line side contact strap 58 includes a stationary contact 64 and load side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 3) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein toggle handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 5) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 6:
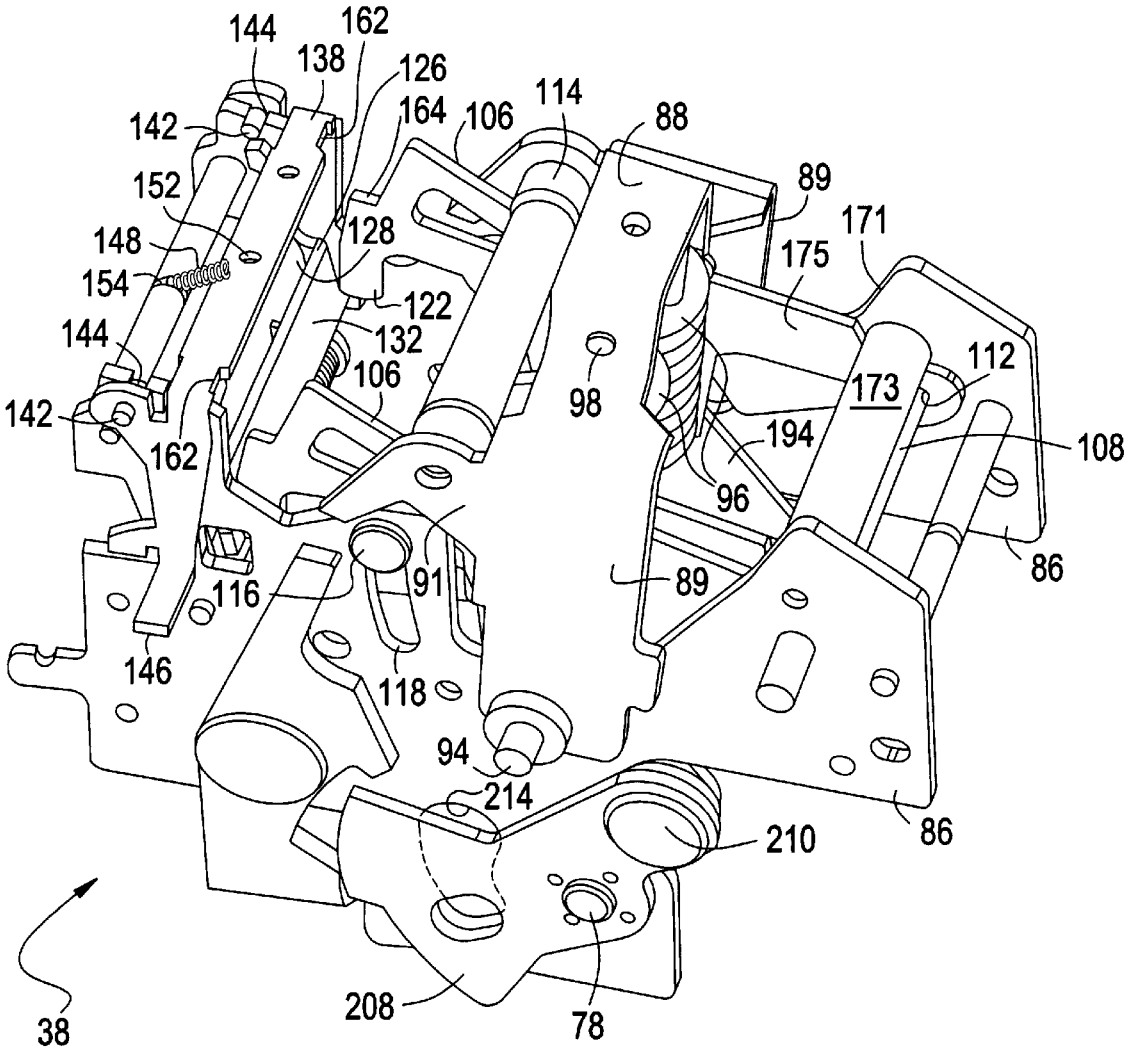
FIG. 6 is an isometric view of the operating mechanism.
Figure 7:
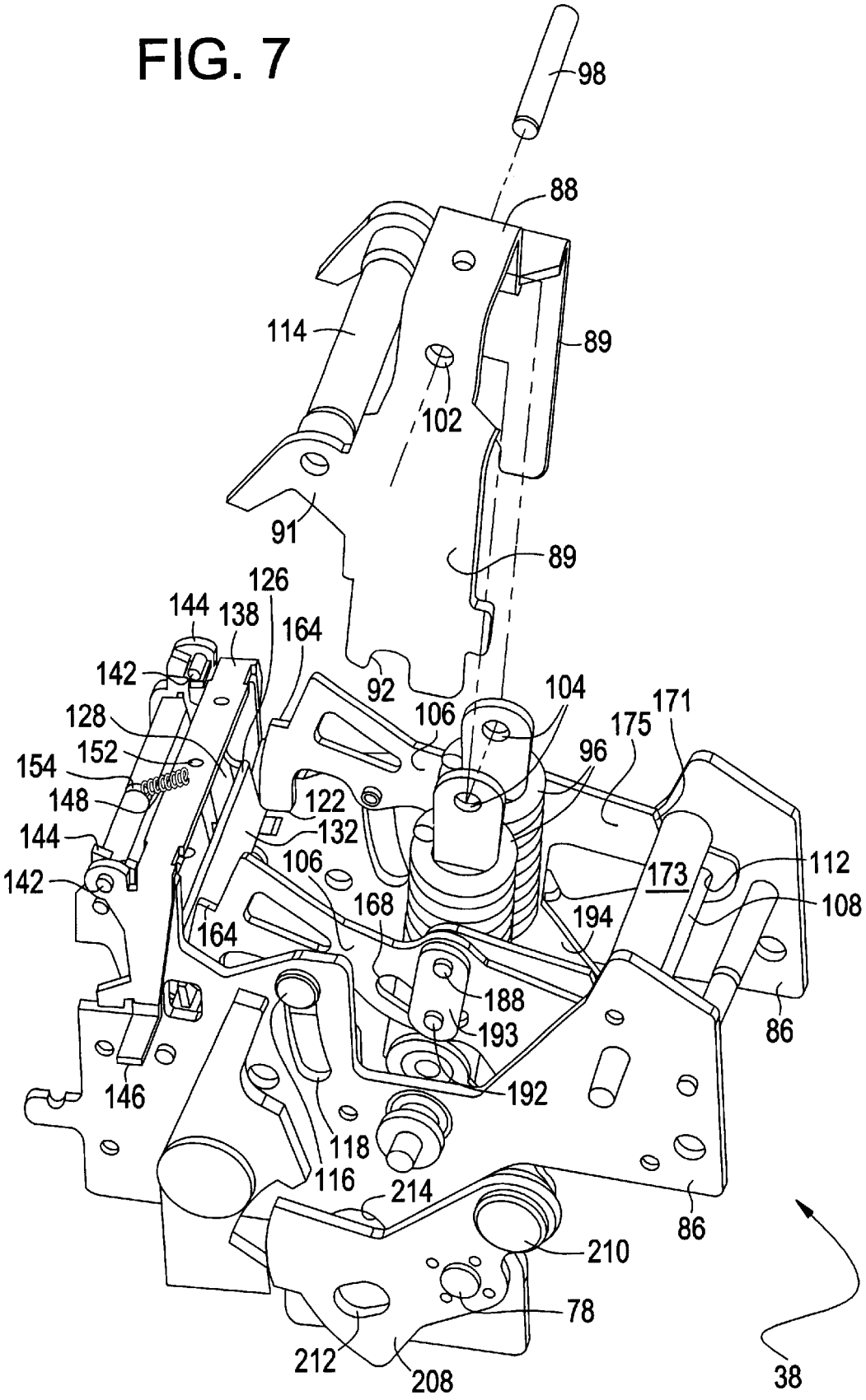
FIG. 7 is a partially exploded view of the operating mechanism.
Figure 8:
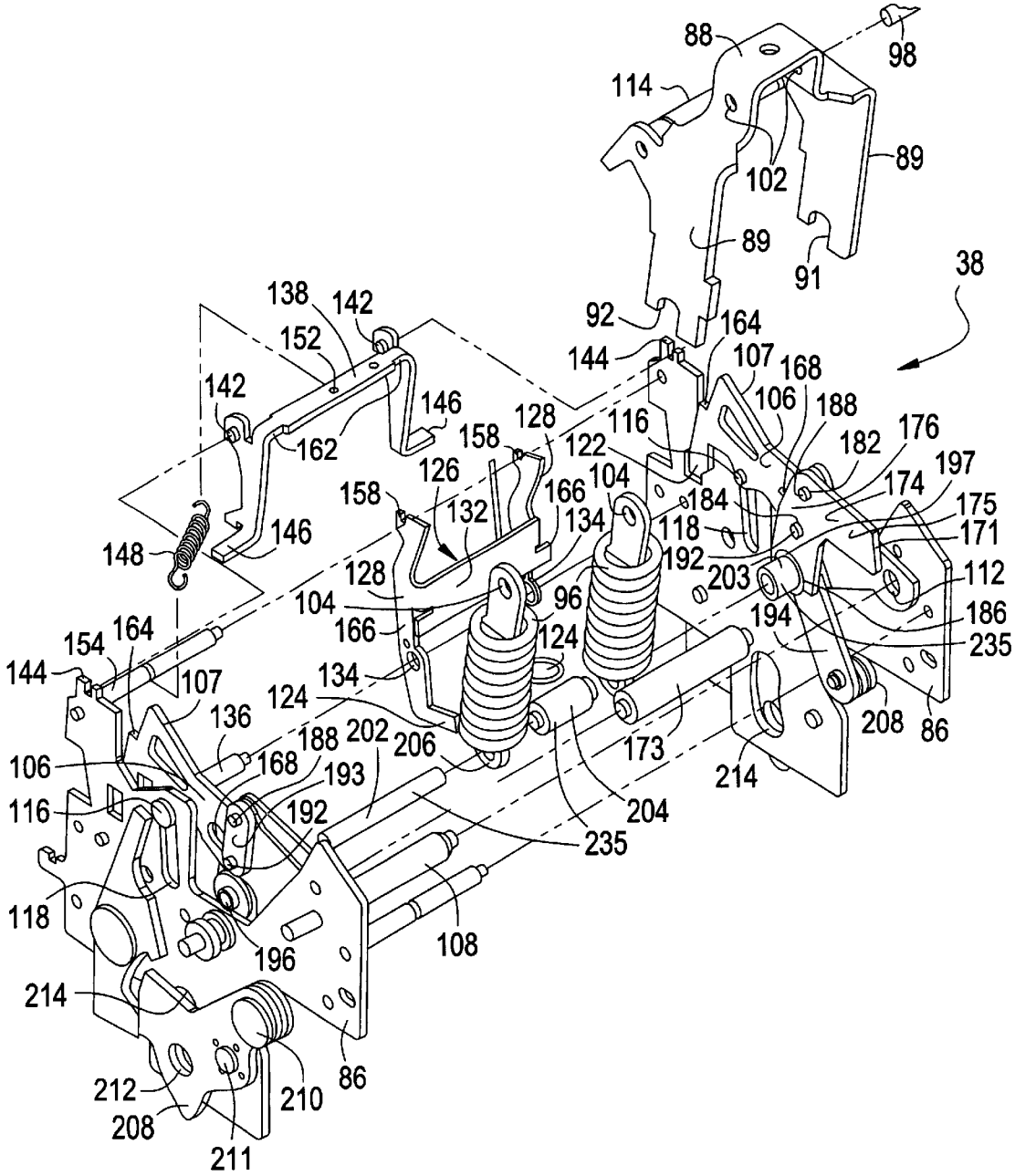
FIG. 8 is another partially exploded view of the operating mechanism.

Referring now to FIGS. 6–8, the components of operating mechanism 38 will now be detailed. As viewed in FIGS. 6–8, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 9:
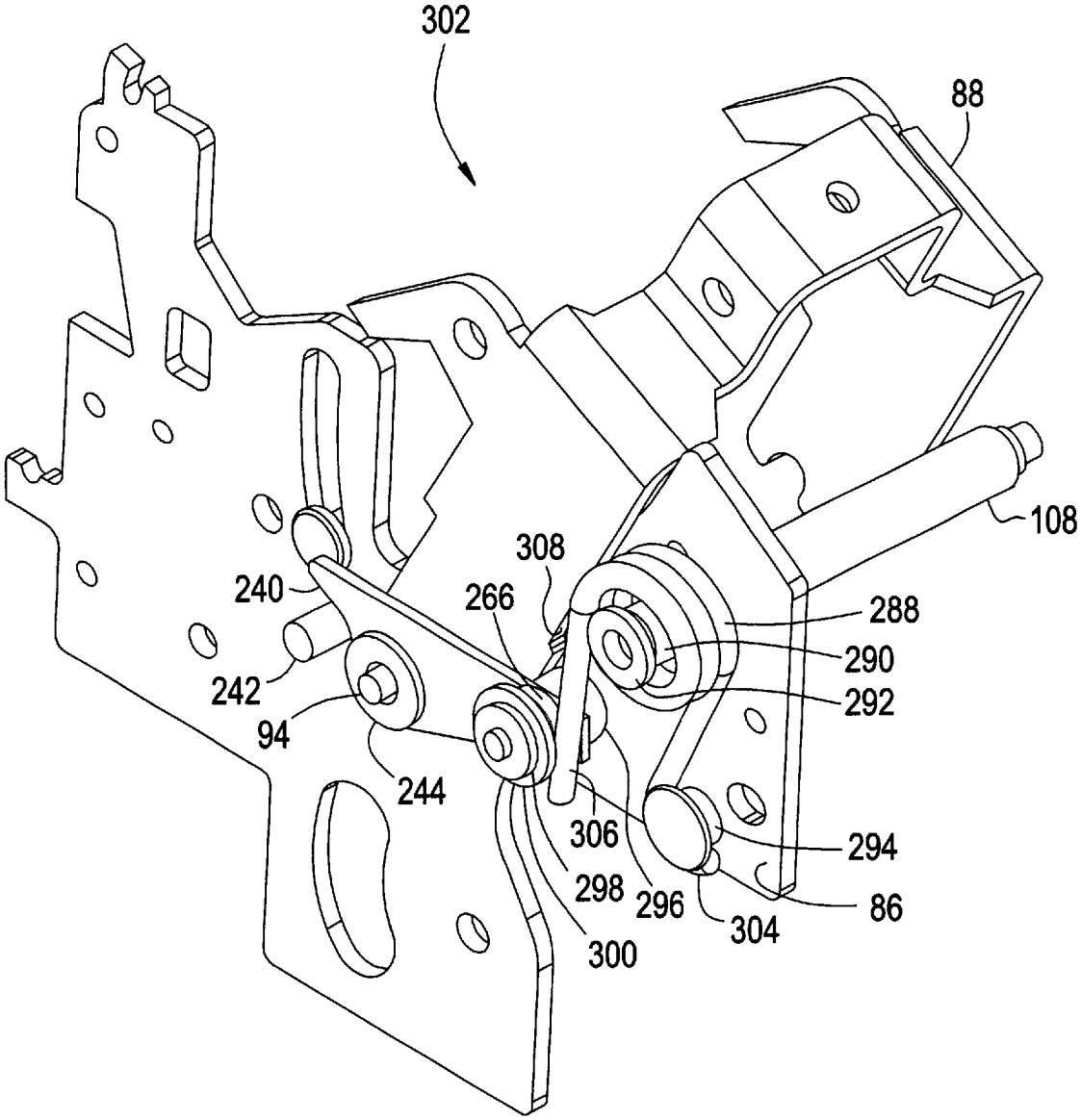
FIG. 9 is an isometric view of the return spring mechanism.

Referring to FIG. 9, a return spring mechanism 302 configured for operation with the operating mechanism side frame 86 is shown in the "on" position. It is noted that the return spring mechanism 302 is located on one side of the operating mechanism 38 (FIG. 2).

An extension 290 of pin 108 is disposed through an opening of the operating mechanism side frame 86. A link 240 is configured for rotation about the bearing portion 94. A pin 242 extends outward from the operating mechanism side frame 86. Pin 242 is configured to make contact with link 240 when the handle yoke 88 rotates counterclockwise in response to an overcurrent condition in the circuit breaker. Pin 242 prevents the further rotation of the handle yoke 88 once the handle yoke 88 reaches a predetermined position. A pin 296 is fixedly attached to one side of link 240. Pin 296 is configured for surface contact engagement of the handle yoke 88. A roller 266 is fixedly attached to the opposing side of link 240. Pin 296 and roller 266 rotate with the link 240 about the bearing portion 94.

A return spring 288 has a fixed first end 304 and a moveable second end 306. First end 304 is attached to the operating mechanism side frame 86 by a rivet pin 294. Second end 306 contacts the surface of roller 266. Return spring 288 is pre-loaded and applies a force normal to the contact surface of the roller. A bushing 300 is attached to roller 266 and is configured to maintain the contact of the second end 306 of the return spring 288 with the roller 266. A bearing 298 is configured to retain the bushing 300, roller portion 266, link 240, and pin 296. Bushing 300, roller portion 266 and pin 296 are fixedly attached to the link 240 and rotate in unison with link 240. Return spring 288 is coiled around extension portion of pin 290.

Figure 10:
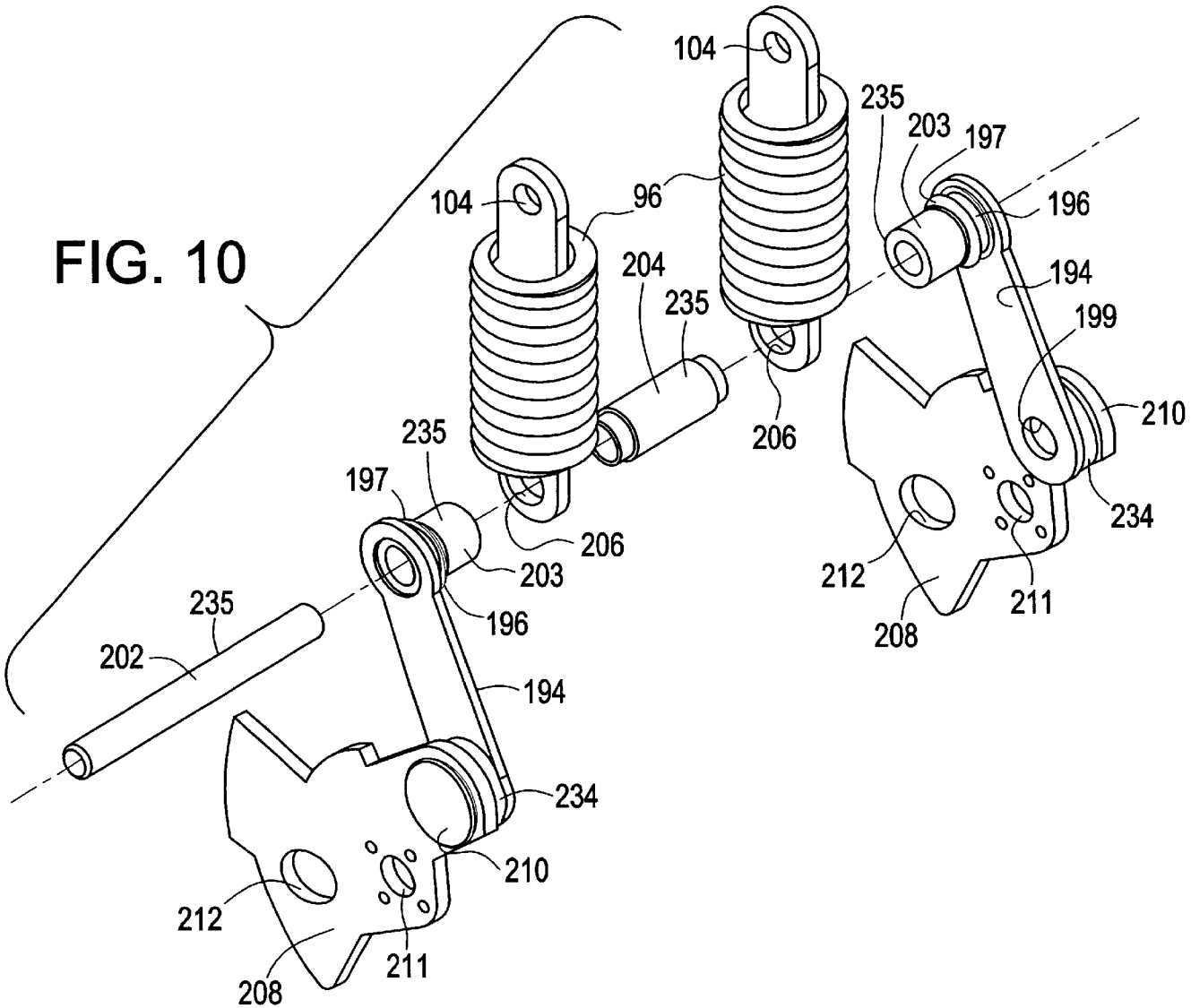
FIG. 10 is an exploded view of a pair of mechanism springs and associated linkage components within the operating mechanism.

Referring to FIG. 10, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 11:
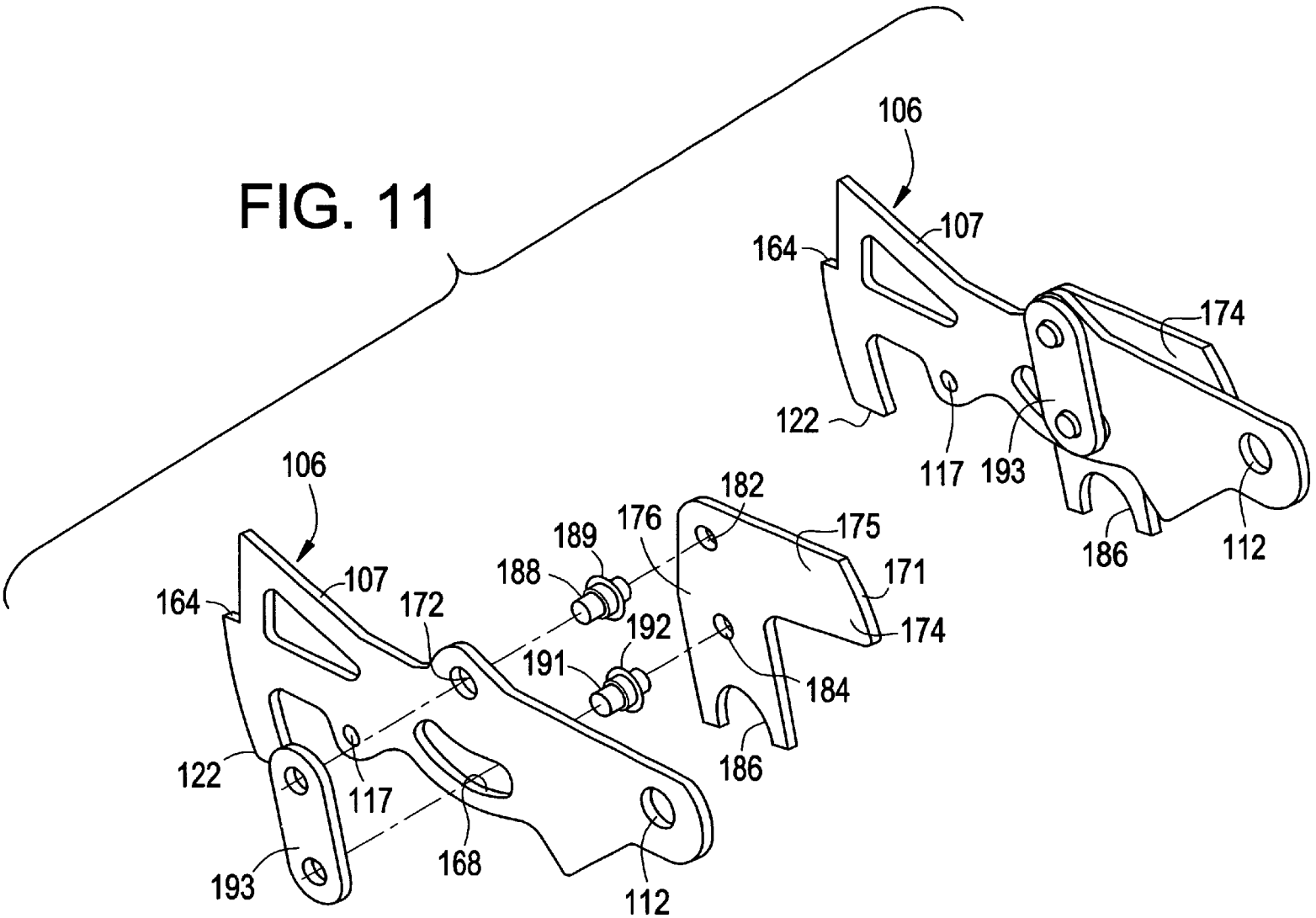
FIG. 11 is an isometric and exploded view of linkage components within the operating mechanism.

Referring to FIGS. 8 and 11, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. The movement of each cradle 106 is guided by a rivet 116 disposed through an arcuate slot 118 within each side frame 86. Rivets 116 are disposed within an opening 117 on each the cradle 106. An arcuate slot 168 is positioned intermediate to opening 112 and opening 117 on each cradle 106. An opening 172 is positioned above slot 168.

Referring back to FIGS. 6–8, a primary latch 126 is positioned within side frame 86. Primary latch 126 includes a pair of side portions 128. Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped" position (e.g., as in FIG. 5), described below. Secondary latch 138 includes a set of latch surfaces 162 that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 8 and 11, a set of upper links 174 are connected to cradles 106. Upper links 174 generally have a right angle shape. Legs 175 (in a substantially horizontal configuration and FIGS. 8 and 11) of upper links 174 each have a cam portion 171 that interfaces a roller 173 disposed between frames 86. Legs 176 (in a substantially vertical configuration in FIGS. 8 and 11) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Figure 12B:
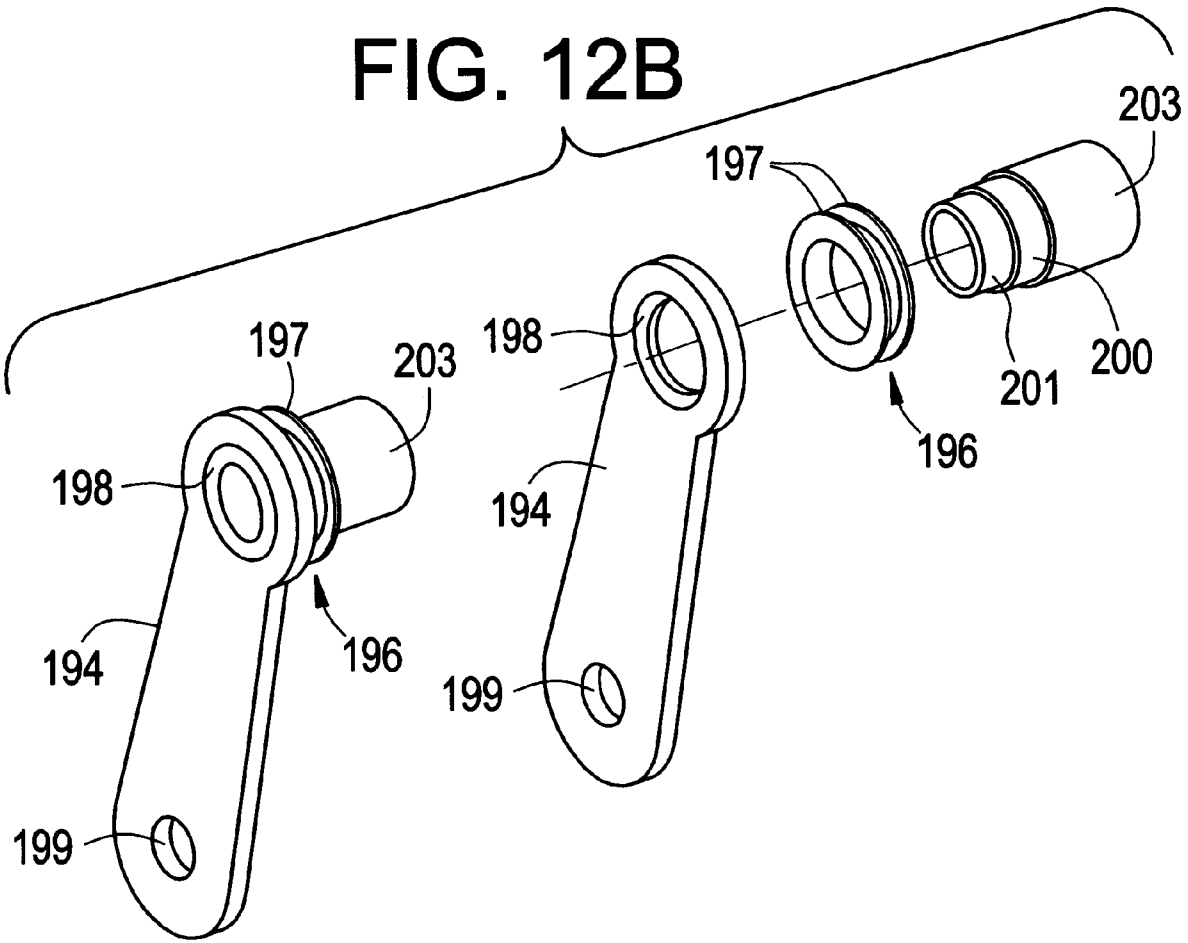
FIG. 12 is a front, isometric, and partially exploded isometric views of a linkage component within the operating mechanism.
Figure 12A:
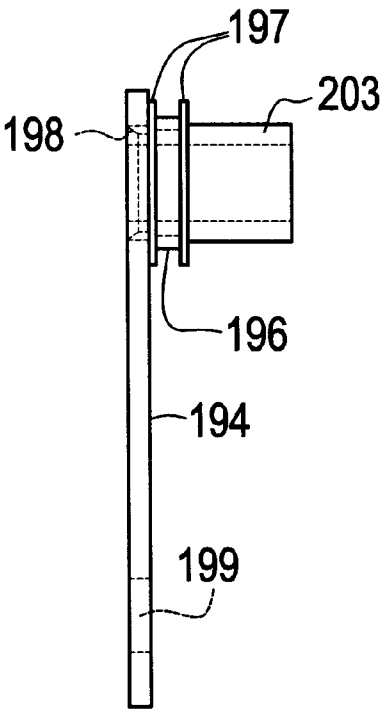

Upper links 174 are each interconnected with a lower link 194. Referring now to FIGS. 8, 11 and 12, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 13:
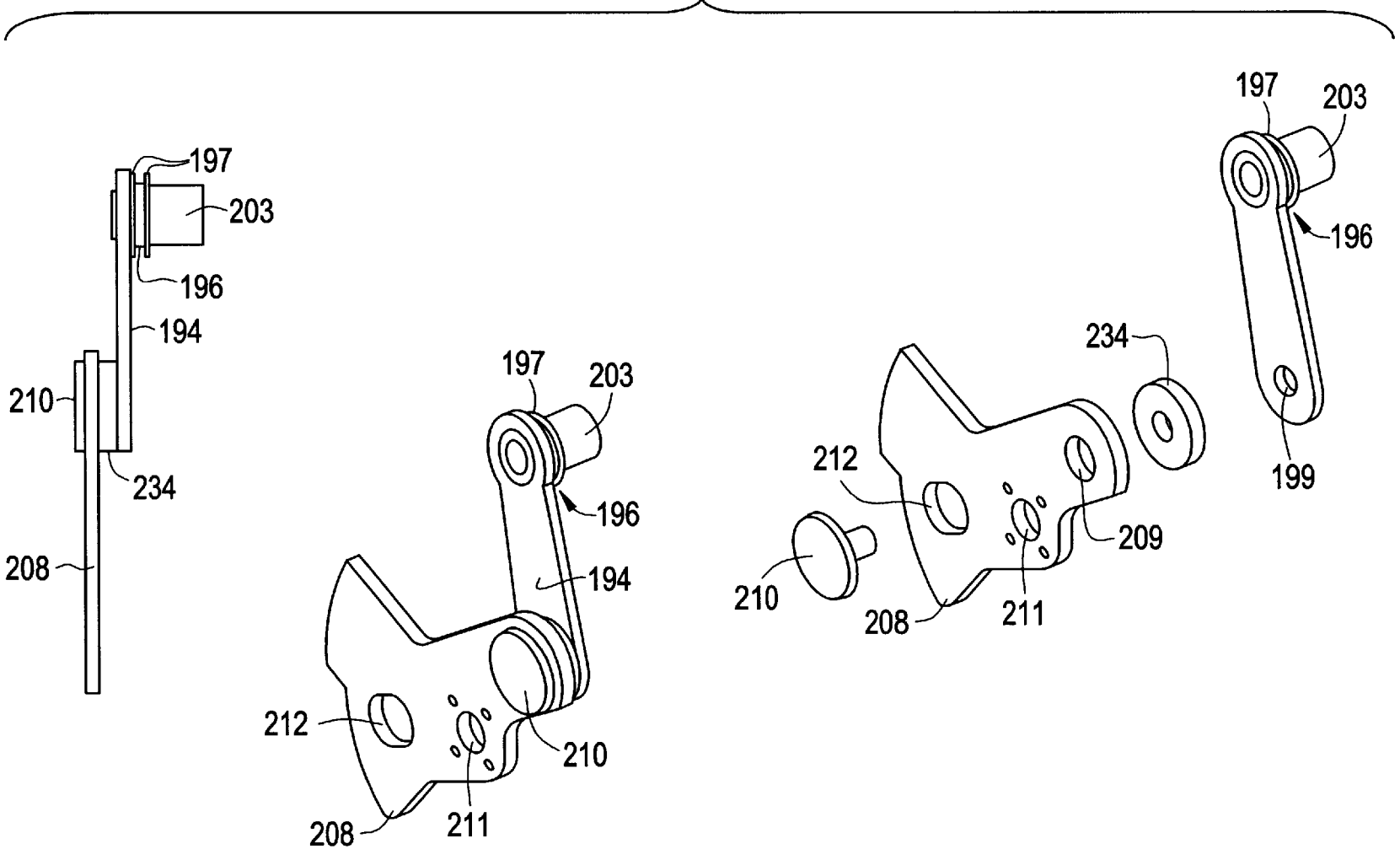
FIG. 13 is a front, isometric, and partially exploded isometric views of linkage components within the operating mechanism.

Referring to FIG. 13, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 8).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Figure 14:
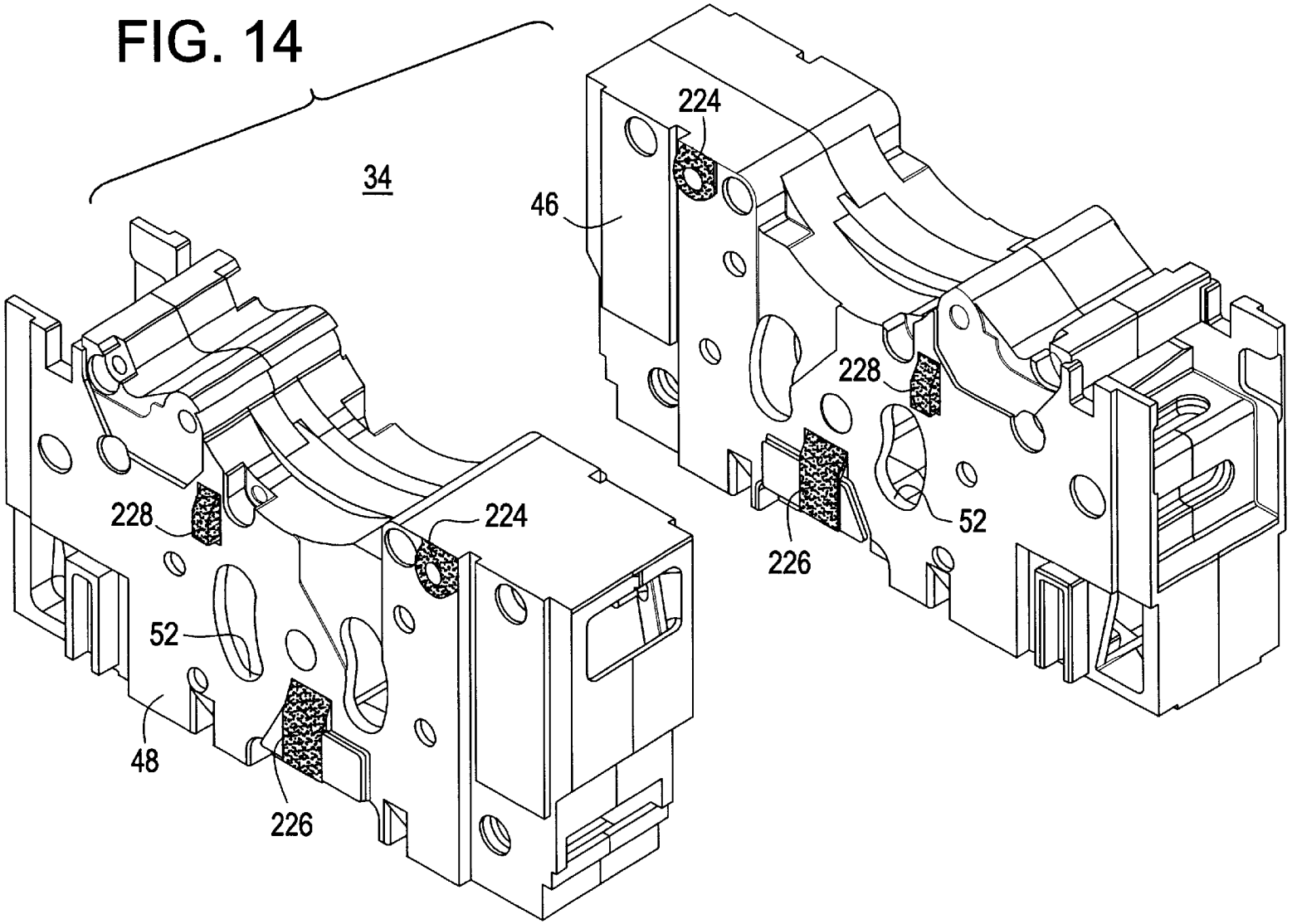
FIG. 14 depicts isometric views of the opposing sides of a cassette employed within the circuit interrupter.

Referring to FIG. 14, views of both sidewalls 46 and 48 of cassette 34 are depicted. Sidewalls 46 and 48 include protrusions or bosses 224, 226 and 228 thereon. Bosses 224, 226 and 228 are attached to sidewalls 46, 48, or can be molded features on sidewalls 46, 48. Note that cassette 34 is depicted and certain features are described herein because operating mechanism 38 straddles cassette 34, i.e., the central cassette, in circuit breaker 20. It is contemplated that the features may be incorporated in cassettes in other positions, and with or without operating mechanism 38 included thereon, for example, if it is beneficial from a manufacturing standpoint to include the features on all cassettes.

Figure 15:
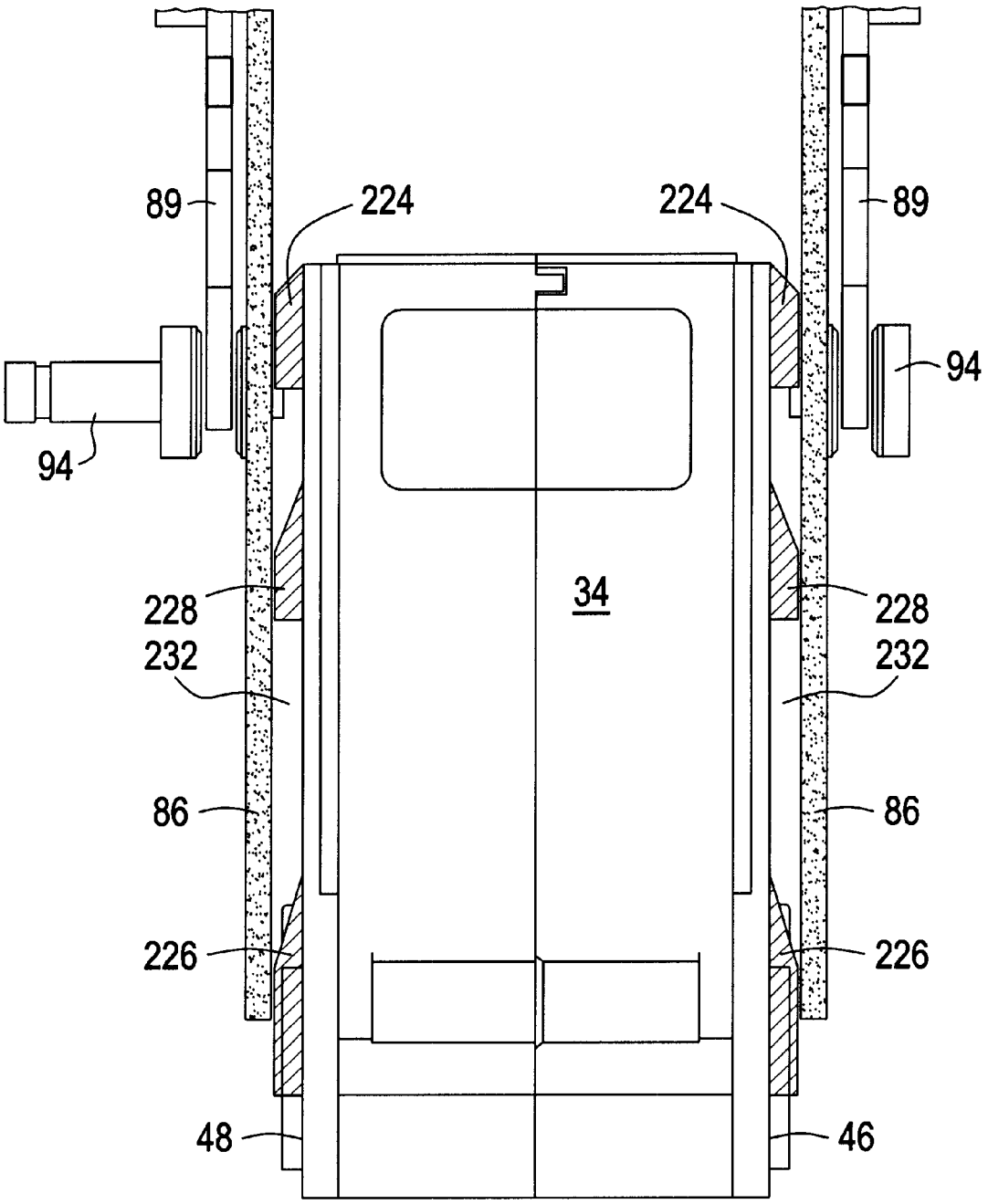
FIG. 15 is a front view of the cassette and the operating mechanism positioned thereon.
Figure 16:
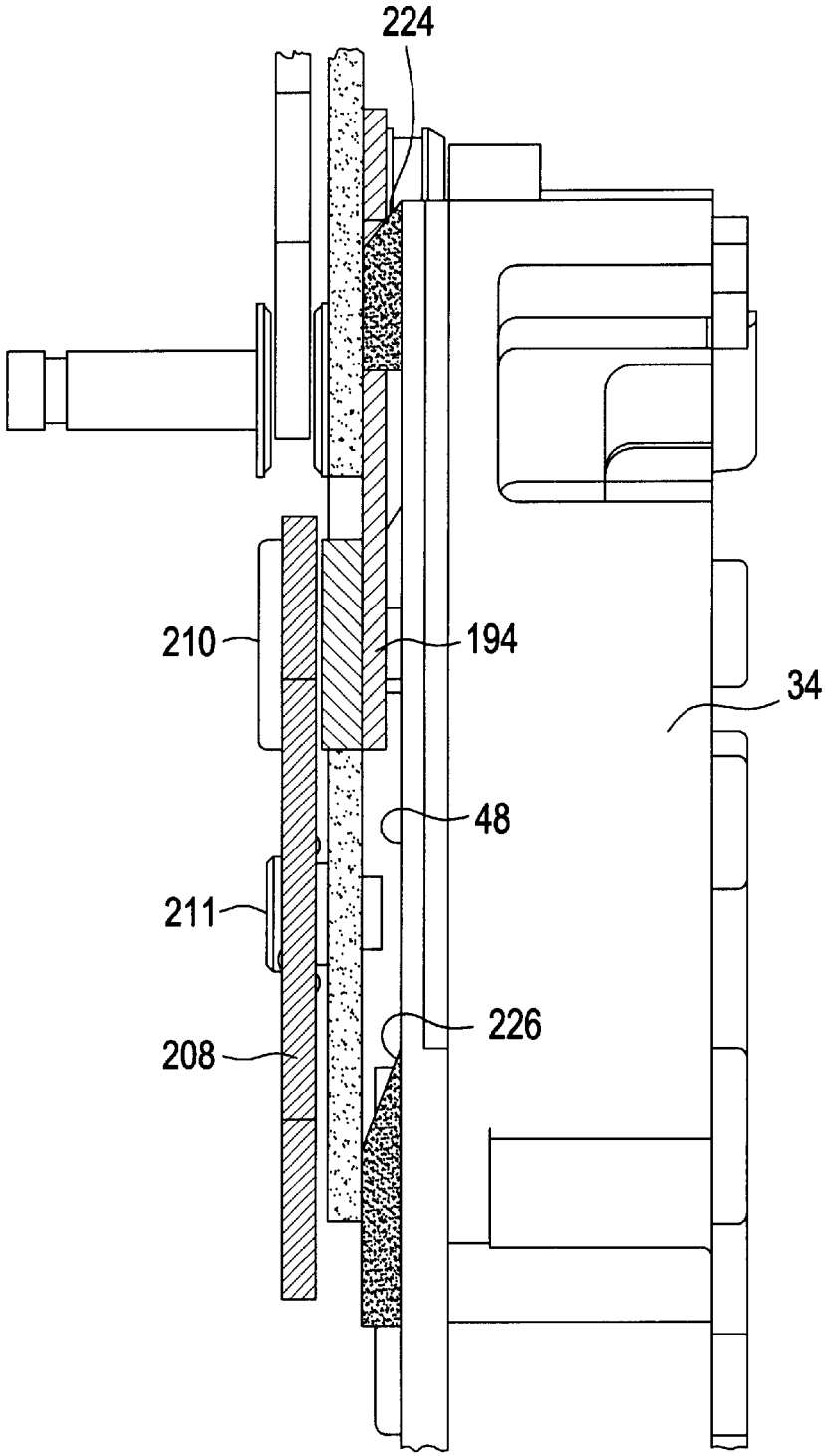
FIG. 16 is a partial front view of the cassette and the operating mechanism positioned thereon.

Referring now to FIG. 15, side frames 86 of operating mechanism 38 are positioned over sidewall 46, 48 of cassette 34. Portions of the inside surfaces of side frames 86 contact bosses 224, 226 and 228, creating a space 232 between each sidewall 46, 48 and each side frame 86. Referring now also to FIG. 15, space 232 allows lower links 194 to properly transmit motion to cranks 208 without binding or hindrance due to frictional interference from sidewalls 46, 48 or side frames 86.

Additionally, the provision of bosses 224, 226 and 228 widens the base of operating mechanism 38, allowing for force to be transmitted with increased stability. Accordingly, bosses 224, 226 and 228 should be dimensioned sufficiently large to allow clearance of links 194 without interfering with adjacent cassettes such as cassettes 32 and 36.

Referring back to FIGS. 3–5, the movement of operating mechanism 38 relative to rotary contact assembly 56 will be detailed.

Referring to FIG. 3, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force was applied to toggle handle 44 to move it from the "off"

position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised portions 189 and 192 (FIG. 11) maintain a suitable space between the surfaces of upper links 174 and cradles 106 to prevent friction therebetween, which would increase the required set operating mechanism 38 from "off" to "on". Furthermore, side walls 197 of bearing washers 196 (FIG. 12) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66. Each spacer 234 on pivotal rivet 210 (FIGS. 10 and 13) maintain the appropriate distance between lower links 194 and cranks 208 to prevent interference or friction therebetween or from side frames 86.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188, 191 to upper link 174 (having cam surface 171) . After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

Referring to FIG. 9, the return spring mechanism 302 utilized with the operating mechanism 38, and more specifically the handle yoke 88, operates as follows. When the circuit beaker is "on", the return spring 288 is preloaded and applies a force normal to the surface of the roller 266. At this point, link 240 is not in contact with pin 242.

Once the circuit breaker trips due to an overcurrent condition as shown in FIG. 5, the operating mechanism 38 operates as previously described. The handle yoke 88 will rotate a first distance about bearing portion 94 towards the handle yoke position when the circuit breaker is "off". Once the handle yoke 88 is set in motion due to the trip condition, pin 296 will move upward along an edge 308 of handle yoke 88 causing link 240 to rotate counterclockwise. This action will cause the return spring 288 to apply a force normal to the edge 308 at the point of contact with roller 266. As the pin 296 moves upward along the handle yoke 88, the distance between the point of contact on edge 308 and the bearing portion 94 increases, thus increasing the moment generated by the return spring 288 to rotate the handle yoke 88 about the bearing portion 94. The additional force applied by return spring 288 causes the handle yoke to move an additional second distance. The movement of the additional second distance positions the handle yoke 88 at an intermediate position that is located between the position of the handle yoke 88 when the circuit breaker is "on" and when the circuit breaker is "off". Link 240 makes contact with pin 242 thereby preventing further movement of the handle yoke 88 beyond a predetermined position that is intermediate the two handle yoke positions shown in FIGS. 3 and 4.

When the circuit breaker is reset after a trip has occurred, the handle yoke 88 is moved from the "trip" position to the "on" position. When the handle yoke 88 is moved to the "on" position, the moveable contacts 72, 74 make contact with the stationary contacts 64, 66 as described herein with reference to FIG. 4. Because the return spring mechanism 302 is external to the operating mechanism 38, it does not detract from the closing force applied to the cassette 32, 34, 36 to affect this closure. Thus, the return spring 288 operates to apply an additional force to the handle yoke during a trip condition moving the handle yoke 88 to a predetermined intermediate position.

It is within the scope of this invention and understood by those skilled in the art, that the return spring mechanism 302 configured to interact with the operating mechanism 38 can be utilized in a single or multi-pole circuit breaker. Further, the circuit breaker can be either a rotary type in which case the operating mechanism 38 attaches to the exterior of a cassette 32, 34, 36 or, alternatively, a conventional type in which case the operating mechanism 38 attaches to the external support structure or base.

It is also within the scope of this invention that the first end 304 of return spring 288 may be alternatively mounted to the exterior of the cassette. Also, second end 306 of return spring 288 may alternatively be mounted to handle yoke 88. Further, although a return spring 288 (e.g. torsion spring) is preferred, it is within the scope of this invention, that alternative spring types may also be utilized. Finally, the force level applied by the return spring 288 can be easily adjusted to accommodate various sizes of circuit breakers in which the return spring mechanism 302 is utilized.

The advantage of the return spring mechanism 302 is that it provides an additional force to the handle yoke 88 when the circuit breaker is in a tripped position. This additional force moves the handle yoke 88 to an intermediate position located between the two handle yoke positions when the circuit breaker is "on" and "off". Thus, once the handle yoke 88 is placed in an intermediate position, a clear indication that the circuit breaker has tripped is provided. It should be noted that the return spring mechanism 302 provides clear trip indication when used with either a handle yoke 88 or accessory mounted to the handle.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An operating mechanism for use in a circuit breaker, the operating mechanism comprising:

a frame;

a handle yoke pivotally connected to said frame;

a spring configured to move said handle yoke a first distance when the operating mechanism is in a tripped condition; and a return spring arranged to move said handle yoke a second distance when the operating mechanism is in a tripped condition.

2. The operating mechanism of claim 1, further including:

a link pivotally connected to said handle yoke about a bearing portion; and a pin fixedly connected to said link and engaging said handle yoke wherein said return spring includes a fixed end connected to said frame and a moveable end engaging said pin.

3. The operating mechanism of claim 2 wherein said pin is a roller.

4. The operating mechanism of claim 2 further including a roller connected to said link opposite said pin, said roller engaging said moveable end of said return spring to move said handle yoke said second distance.

5. The operating mechanism of claim 1 further including a pin fixedly connected to said frame proximate a link to restrain said pin from moving said handle yoke beyond said second distance.

6. The operating mechanism of claim 1 wherein said return spring is a torsion spring.

7. A circuit breaker comprising:

a fixed contact;

a moveable contact arranged proximate said fixed contact; and an operating mechanism operatively connected to said moveable contact for separating said moveable contact from said fixed contact, said operating mechanism including:

a frame, a handle yoke pivotally connected to said frame, a spring configured to move said handle yoke a first distance when the operating mechanism is in a tripped condition, and a return spring arranged to move said handle yoke a second distance when the operating mechanism is in a tripped condition.

8. The circuit breaker of claim 7, further including:

a link pivotally connected to said handle yoke about a bearing portion; and a pin fixedly connected to said link and engaging said handle yoke wherein said return spring includes a fixed end connected to said frame and a moveable end engaging said pin.

9. The circuit breaker of claim 8 wherein said pin is a roller.

10. The circuit breaker of claim 8 further including a roller connected to said link opposite said pin, said roller engaging said moveable end of said return spring to move said handle yoke said second distance.

11. The circuit breaker of claim 7 further including a pin fixedly connected to said frame proximate a link to restrain said pin from moving said handle yoke beyond said second distance.

12. The circuit breaker of claim 7 wherein said return spring is a torsion spring.

* * * * *